US010872597B2

(12) United States Patent
Mori et al.

(10) Patent No.: US 10,872,597 B2
(45) Date of Patent: Dec. 22, 2020

(54) SPEECH SYNTHESIS DICTIONARY DELIVERY DEVICE, SPEECH SYNTHESIS SYSTEM, AND PROGRAM STORAGE MEDIUM

(71) Applicants: Kabushiki Kaisha Toshiba, Minato-ku (JP); Toshiba Digital Solutions Corporation, Kawasaki (JP)

(72) Inventors: Kouichirou Mori, Kawasaki (JP); Gou Hirabayashi, Tatebayashi (JP); Masahiro Morita, Yokohama (JP); Yamato Ohtani, Sakai (JP)

(73) Assignees: Kabushiki Kaisha Toshiba, Minato-ku (JP); Toshiba Digital Solutions Cornoration, Kawasaki (JP)

( * ) Notice: Subject to any disclaimer, the term of this patent is extended or adjusted under 35 U.S.C. 154(b) by 150 days.

(21) Appl. No.: 16/058,229

(22) Filed: Aug. 8, 2018

(65) Prior Publication Data

US 2019/0066656 A1 Feb. 28, 2019

(30) Foreign Application Priority Data

Aug. 29, 2017 (JP) ..... 2017-164343

(51) Int. Cl.
*G10L 13/08* (2013.01)
*G10L 13/047* (2013.01)
*G10L 13/033* (2013.01)

(52) U.S. Cl.
CPC ..... *G10L 13/047* (2013.01); *G10L 13/08* (2013.01); *G10L 13/033* (2013.01)

(58) Field of Classification Search
CPC ..... G10L 13/00; G10L 15/063; G10L 13/033; G10L 15/07; G10L 15/187; G10L 15/02;
(Continued)

(56) References Cited

U.S. PATENT DOCUMENTS 5,033,087 A * 7/1991 Bahl ..... G10L 15/14 704/245
8,180,630 B2 * 5/2012 Goud ..... G06F 40/242 704/10

(Continued)

FOREIGN PATENT DOCUMENTS

JP 2003-029774 1/2003
JP 2017-058513 3/2017

OTHER PUBLICATIONS

Keiichi Tokuda, et al., "Speech Synthesis Based on Hidden Markov Models," Proceedings of the IEEE, vol. 101, No. 5, May 2013, pp. 1234-1252.

(Continued)

*Primary Examiner* — Vijay B Chawan
(74) *Attorney, Agent, or Firm* — Oblon, McClelland, Maier & Neustadt, L.L.P.

(57) ABSTRACT

A speech synthesis dictionary delivery device that delivers a dictionary for performing speech synthesis to terminals, comprises a storage device for speech synthesis dictionary database that stores a first dictionary which includes an acoustic model of a speaker and is associated with identification information of the speaker, that stores a second dictionary which includes an acoustic model generated using voice data of a plurality of speakers, and that stores parameter sets of the speakers to be used with the second dictionary and which are associated with identification information of the speakers, a processor that determines one of the first dictionary and the second dictionary, which should be used in the terminal for a specified speaker, and an input output interface (I/F) that receives the identification information of a speaker transmitted from the terminal and then delivers at least one of a first dictionary, the second dictionary, and a parameter set of the second dictionary, on the basis of the
(Continued)

received identification information of the speaker and a result of the determination by the processor.

15 Claims, 19 Drawing Sheets

(58) Field of Classification Search
CPC ..... G10L 15/10; G10L 15/16; G10L 15/19; G10L 15/22; G10L 25/51; G10L 13/08; G10L 15/14; G10L 15/26; G10L 15/30; G10L 2015/0531; G06F 40/40; G06F 40/58; G06F 3/16; G06F 40/232; G06F 40/242; G06F 40/274
USPC ..... 704/251, 10, 2, 220, 243, 245, 246, 704/256.5, 258, 270, 270.1, 3
See application file for complete search history.

(56) References Cited

U.S. PATENT DOCUMENTS 9,484,012 B2 * 11/2016 Morita ..... G10L 13/033
9,812,122 B2 * 11/2017 Kurata ..... G10L 15/063
9,922,641 B1 * 3/2018 Chun ..... G10L 13/033
10,255,907 B2 * 4/2019 Nallasamy ..... G10L 15/07
10,347,237 B2 * 7/2019 Tachibana ..... G10L 13/00
2003/0009340 A1 * 1/2003 Hayashi ..... G10L 13/00 704/270
2004/0172247 A1 * 9/2004 Yoon ..... G10L 15/187 704/251
2010/0185446 A1 * 7/2010 Homma ..... G09B 19/04 704/251
2013/0282359 A1 * 10/2013 Kim ..... G06F 40/58 704/3
2014/0281944 A1 * 9/2014 Winer ..... G06F 40/274 715/259
2014/0303958 A1 * 10/2014 Lee ..... G10L 13/08 704/2
2015/0228271 A1 * 8/2015 Morita ..... G10L 13/033 704/258
2016/0012035 A1 * 1/2016 Tachibana ..... G10L 13/00 704/10
2016/0086599 A1 * 3/2016 Kurata ..... G10L 15/063 704/243
2016/0358600 A1 * 12/2016 Nallasamy ..... G10L 15/07
2017/0076715 A1 3/2017 Ohtani et al.

OTHER PUBLICATIONS

Kengo Shichiri, et al., "Eigenvoices for HMM-Based Speech Synthesis," Proceedings of International Conferene on Spoken Language Processing (ICSLP2002), 2002, 4 Pages.
Makoto Tachibana, et al., "A Technique for Controlling Voice Quality of Synthetic Using Multiple Regression HSMM," Proceedings of Interspeech 2006—ICSLP, pp. 2438-2441.
Yamato Ohtani, et al., "Voice quality control using perceptual expressions for statistical parametric speech synthesis based on cluster adaptive training," Proceedings of Interspeech 2016, pp. 2258-2262.

* cited by examiner

FIG. 2

202 203 204

| SPEAKER ID | FIRST DICTIONARY FILE NAME | SPEAKER PARAMETER USED IN SECOND DICTIONARY |
|---|---|---|
| 1 | speaker00001.dicL | [32, 80, 41, 20, 52, 55, 39] |
| 2 | speaker00002.dicL | [4, 77, 19, 39, 36, 19, 73] |
| 3 | speaker00003.dicL | [59, 23, 96, 37, 57, 73, 93] |
| 4 | speaker00004.dicL | [41, 72, 15, 79, 24, 40, 87] |
| 5 | speaker00005.dicL | [5, 41, 85, 79, 80, 90, 48] |
| 6 | speaker00006.dicL | [24, 24, 37, 70, 19, 56, 71] |
| 7 | speaker00007.dicL | [80, 50, 93, 24, 1, 70, 84] |
| 8 | speaker00008.dicL | [40, 78, 33, 70, 19, 25, 44] |
| 9 | speaker00009.dicL | [17, 85, 57, 29, 61, 39, 85] |
| 10 | speaker00010.dicL | [80, 40, 38, 3, 92, 99, 77] |
| ... | ... | ... |

201

FIG. 3

302 303 304 301

| SPEAKER ID | FIRST DICTIONARY FILE NAME | SPEAKER PARAMETER USED IN SECOND DICTIONARY |
|---|---|---|
| 1 | speaker00001.dicL | |
| 2 | | |
| 3 | | |
| 4 | | [41, 72, 15, 79, 24, 40, 87] |
| 5 | | [5, 41, 85, 79, 80, 90, 48] |
| 6 | speaker00006.dicL | |
| 7 | speaker00007.dicL | [80, 50, 93, 24, 1, 70, 84] |
| 8 | | |
| 9 | | |
| 10 | | [80, 40, 38, 3, 92, 99, 77] |
| ... | ... | ... |

FIG. 10

1002 1003 1001

| SPEAKER ID | USER 1 | USER 2 | USER 3 | USER 4 | ... |
|---|---|---|---|---|---|
| 1 | 100 | 0 | 0 | 0 | |
| 2 | 85 | 0 | 0 | 0 | |
| 3 | 0 | 100 | 0 | 0 | |
| 4 | 90 | 50 | 0 | 0 | |
| 5 | 0 | 0 | 100 | 0 | |
| 6 | 0 | 0 | 80 | 0 | |
| 7 | 0 | 0 | 50 | 70 | |
| 8 | 10 | 0 | 30 | 50 | |
| 9 | 30 | 0 | 0 | 100 | |
| 10 | 0 | 0 | 0 | 100 | |
| ... | | | | | |

FIG. 14

1402 1403

| SPEAKER ID | SPEAKER DEGREE OF REPRODUCTION |
|---|---|
| 1 | 80 |
| 2 | 20 |
| 3 | 50 |
| 4 | 5 |
| 5 | 90 |
| 6 | 60 |
| 7 | 40 |
| 8 | 30 |
| 9 | 85 |
| 10 | 40 |
| ... | ... |

1401

FIG. 18

1802 1803

| SPEAKER ID | REQUEST FREQUENCY |
|---|---|
| 1 | 800 |
| 2 | 25000 |
| 3 | 500 |
| 4 | 5000 |
| 5 | 300000 |
| 6 | 9000 |
| 7 | 50 |
| 8 | 8000 |
| 9 | 700 |
| 10 | 400 |
| ... | ... |

1801

SPEECH SYNTHESIS DICTIONARY DELIVERY DEVICE, SPEECH SYNTHESIS SYSTEM, AND PROGRAM STORAGE MEDIUM

CROSS-REFERENCE RELATED APPLICATIONS

This application claims the benefit of Japanese Priority Patent Application JP 2017-164343 filed on Aug. 29, 2017, the entire contents of which are incorporated herein by reference.

FIELD

Embodiments of the present invention relate to a speech synthesis dictionary delivery device, a speech synthesis dictionary delivery system, and a program storage medium.

BACKGROUND

In recent years, with the development of speech synthesis technology, it has become possible to generate synthesized speech (sometimes just called "a synthesis speech") of various speakers by a user inputting texts.

For the speech synthesis technology, the following two types of method are considered: (1) a method of directly modeling a voice of a target speaker; and (2) a method of estimating parameters which coincide with a voice of a target speaker through a scheme capable of generating various voices by manipulating parameters (eigenvoice, a multiple regression HSMM, or the like to be described later). In general, the method (1) has an advantage that it can imitate a target speaker's voice better, while the method (2) has an advantage that the data required for specifying a target speaker's voice can be smaller, i.e. just a set of parameters instead of a whole voice model. Recently with use of such speech synthesis technology, a speech synthesis service providing a function or an application of speech synthesis has become known as a web service. For example, if a user selects a speaker on a terminal such as a PC, a PDA, a smart phone or the like, and inputs a text on the terminal, the user can receive a synthetic speech of any utterance that the user would like the speaker to speak. Here, the user refers to a person or organization who uses various synthetic speech using the speech synthesis service, and the speaker refers to a person who provides his/her own utterance samples for generating speech synthesis dictionary and whose synthetic speech are used by the user. If the user has created a speech synthesis dictionary of his/her own voice, it is also possible to select the user as a speaker. In the web service, the synthesis voice and the own voice of the speaker is usually used as a human interface to communicate between two or more users via a network and that is provided on a hardware, such as a server, a PC, a PDA, a smart phone, or the like.

In a case in which synthesized speech of a plurality of speakers are provided through the speech synthesis service on the web, there are the following two types of methods: (a) a method of generating synthesized speech by switching the speakers on a server connected to a network and transmitting them to the user's terminal; and (b) a method of delivering required speech synthesis dictionaries (hereinafter sometimes called "a dictionary") to a speech synthesis engine operating in the terminal. However, in the method (a), the voice is unable to be synthesized unless the terminal is constantly connected to the network. In the method (b), the size or number of dictionaries to be delivered is strongly restricted by a hardware specification of the terminal although the terminal need not be constantly connected to the network. For example, a case in which one or more users would like to use 1,000 different speakers on a single terminal for an application to read many messages from a SNS is considered. Conventionally, in this case a delivery condition (such as a dictionary size) is designated in a dictionary of each speaker and delivering 1,000 speech synthesis dictionaries to the terminal is needed. Thus, it is necessary to store and manage the 1,000 speech synthesis dictionaries on the terminal. It is unrealistic because of a limit of a network band or a storage capacity of the terminal to deliver such large number of dictionaries to the terminal and manage them on it. Further, there is a problem that it is hard to implement an application using a plurality of speakers on a terminal, which is not constantly connected to the network.

BRIEF DESCRIPTION OF THE DRAWINGS

FIG. 2 illustrates an example of a data table stored in a speech synthesis dictionary DB 105 of a dictionary delivery server 100 according to the first embodiment;

FIG. 3 illustrates an example of a data table stored in a speech synthesis dictionary DB 114 of a terminal 110 according to the first embodiment;

FIG. 10 is an example of a speaker degree-of-importance table 1001 according to the second embodiment;

FIG. 14 is a process flow illustrating an example of a method of estimating a speaker degree of reproduction according to the third embodiment;

FIG. 18 illustrates an example of a speaker request frequency table 1801 according to the fourth embodiment.

DESCRIPTION OF EMBODIMENTS

Figure 1:
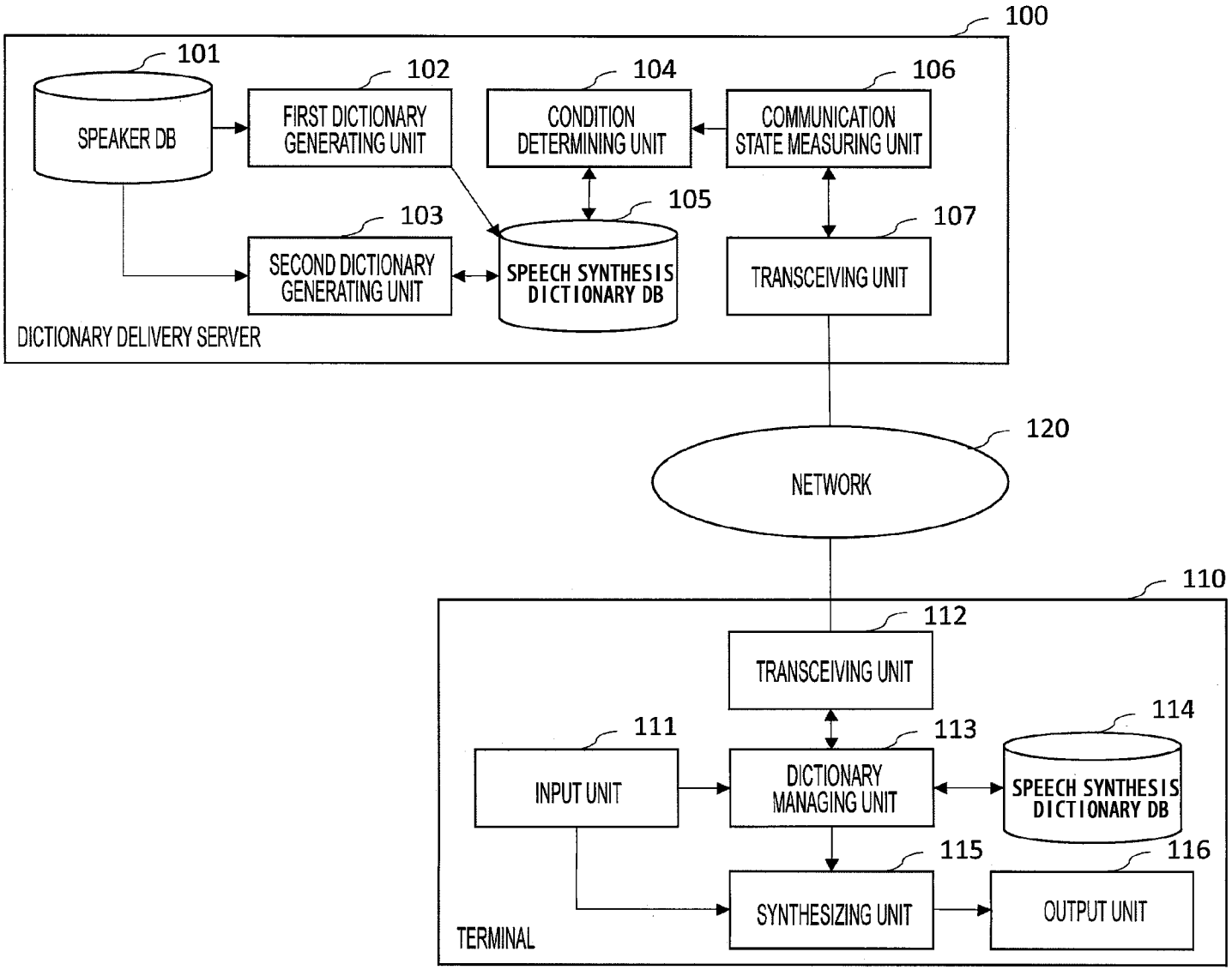
FIG. 1 is a block diagram showing a speech synthesis dictionary delivery system according to a first embodiment.

According to one embodiment, a speech synthesis dictionary delivery device that delivers a dictionary for performing speech synthesis to terminals, comprises a storage device for speech synthesis dictionary database that stores a first dictionary which includes an acoustic model of a speaker and is associated with identification information of the speaker, that stores a second dictionary which includes an acoustic model generated using voice data of a plurality of speakers, and that stores parameter sets of the speakers to be used with the second dictionary and which are associated with identification information of the speakers, a processor that determines one of the first dictionary and the second dictionary, which should be used in the terminal for a specified speaker, and an input output interface (I/F) that receives the identification information of a speaker transmitted from the terminal and then delivers at least one of a first dictionary, the second dictionary, and a parameter set of the second dictionary, on the basis of the received identification information of the speaker and a result of the determination by the processor is provided.

Hereinafter, embodiments will be described with reference to the drawings. In the following description, the same reference numerals are assigned to the same members, and descriptions of members described once are omitted as appropriate.

First Embodiment

FIG. 1 is a block diagram illustrating a speech synthesis dictionary delivery system according to a first embodiment. The speech synthesis dictionary delivery system comprises a dictionary delivery server 100 and a terminal 110, those are connected via a network 120 with each other. Here, "a terminal" means at least one terminal and sometimes includes plural terminals.

The dictionary delivery server 100 includes a speaker database (DB) 101, a first dictionary generating unit 102, a second dictionary generating unit 103, a condition determining unit 104, a speech synthesis dictionary DB 105, a communication state measuring unit 106, and a transceiving unit 107. The terminal 110 includes an input unit 111, a transceiving unit 112, a dictionary managing unit 113, a speech synthesis dictionary DB 114, a synthesizing unit 115, and an output unit 116.

The dictionary delivery server 100 has a hardware structure comprising a CPU, ROM, RAM, I/F, and a storage device, for example. Those parts or elements are usually comprised of a circuitry configuration.
A detail explanation of such hardware structure is described later.

The speaker DB 101 stores recorded voices and recording texts of one or more speakers. The speaker DB 101 is installed in a storage device or a ROM of the dictionary synthesis server 100. A first dictionary and a second dictionary are generated using the recorded voices and the recording texts (hereinafter "a first dictionary" and "a second dictionary" sometimes conveniently just called "a dictionary". Here, "a dictionary" means at least one dictionary and may include plural dictionaries in the embodiments).

The first dictionary generating unit 102 generates the first dictionary, which is a speech synthesis dictionary generated from the recorded voice of the speaker and the recording text in the speaker DB 101. The second dictionary generating unit 103 generates the second dictionary, which is generated from the recorded voices of one or more speakers stored in the speaker DB 101 and estimates a set of parameters of each speaker. The generation of the first dictionary and the second dictionary is controlled by a CPU in the speech synthesis server 100.

The first dictionary is a dictionary with which only a voice of a specific speaker can be synthesized. There are different dictionaries for each speaker, such as a dictionary of the speaker A, a dictionary of the speaker B, and a dictionary of the speaker C.

On the other hand, the second dictionary is a versatile dictionary with which voices of a plurality of speakers can be synthesized by inputting the parameter set of each speaker (indicated by an N dimensional vector). For example, it is possible to synthesize the speech of the speaker A, speaker B, and speaker C by inputting the parameter set of the speaker A, speaker B, and speaker C respectively with the same second dictionary (to be described later in detail).

The first dictionary, the second dictionary, and the parameter sets estimated for respective speakers are stored in the speech synthesis dictionary DB 105. The synthesis dictionary DB 105 is installed in the storage device of the dictionary delivery server 100.

The speech synthesis dictionary DB 105 stores, for example, a data table 201 illustrated in FIG. 2. The data table 201 includes a field for the speaker ID 202, which is identification information of each speaker, one for the first dictionary's file name 203, and one for the speaker parameter set 204 used with the second dictionary. In the present embodiment, the speaker parameter set is represented by a seven-dimensional vector, each element of which takes a value in a range of 0 to 100 and indicates a voice quality feature of the speaker.

The condition determining unit 104 determines one of the first dictionary and the second dictionary, which should be used in the terminal for a specific each speaker when there is a dictionary delivery request from the terminal. In the present embodiment, a communication state of the network 120 is measured by the communication state measuring unit 106 and is used as a criterion of determination. The transceiving unit 107 receives requests from the terminal 110 and delivers dictionaries to it.

The terminal 110 includes the input unit 111, the transceiving unit 112, the dictionary managing unit 113, the speech synthesis dictionary DB 114, the synthesizing unit 115, and the output unit 116. The input unit 111 acquires texts to be synthesized and one or more speakers to be used. The transceiving unit 112 transmits a list of such speakers (i.e. a speaker ID list), acquired by the input unit 111, to the dictionary delivery server 100, and receives the dictionary or the speaker parameter from it.

The dictionary managing unit 113 refers to the speech synthesis dictionary DB 114 in the terminal and determines whether or not the terminal 110 has already received from the dictionary delivery server 100 the first dictionary and the speaker parameter set of the second dictionary for each speaker in the speaker ID list. In a case in which neither the first dictionary nor the speaker parameter set have been delivered for a speaker in the speaker ID list, the dictionary managing unit 113 transmits a dictionary delivery request to the dictionary delivery server 100. Further, in a case in which the first dictionary or parameter set of the second dictionary has already been delivered from the dictionary delivery server 100, the dictionary managing unit 113 determines which of the first dictionary and the second dictionary to use to synthesize the speech.

The speech synthesis dictionary DB 114 of the terminal stores, for example, a data table 301 illustrated in FIG. 3. The data table 301 includes a field for the speaker ID 302, which is to be transmitted to the dictionary delivery server 100 in dictionary delivery requests, one for the first dictionary file name 303 delivered from the dictionary delivery server 100, and one for the speaker parameter 304 used with the second dictionary. Unlike the data table 201 stored in the speech synthesis dictionary DB 105 of the dictionary delivery server 100, values of the first dictionary and the speaker parameter set that have not been delivered yet are indicated by blanks in the data table 301. The dictionary managing unit 113 determines whether or not the first dictionary or the speaker parameter set have been delivered for the speaker ID to be used for speech synthesis, based on whether or not the corresponding entry in the data table is blank. Further, the second dictionary is also stored in the speech synthesis dictionary DB 114, separately from the data table 301.

The synthesizing unit 115 synthesizes the speech from the text, using the first dictionary or the combination of the second dictionary and the parameter set. The output unit 116 reproduces a synthetic speech.

Figure 4:
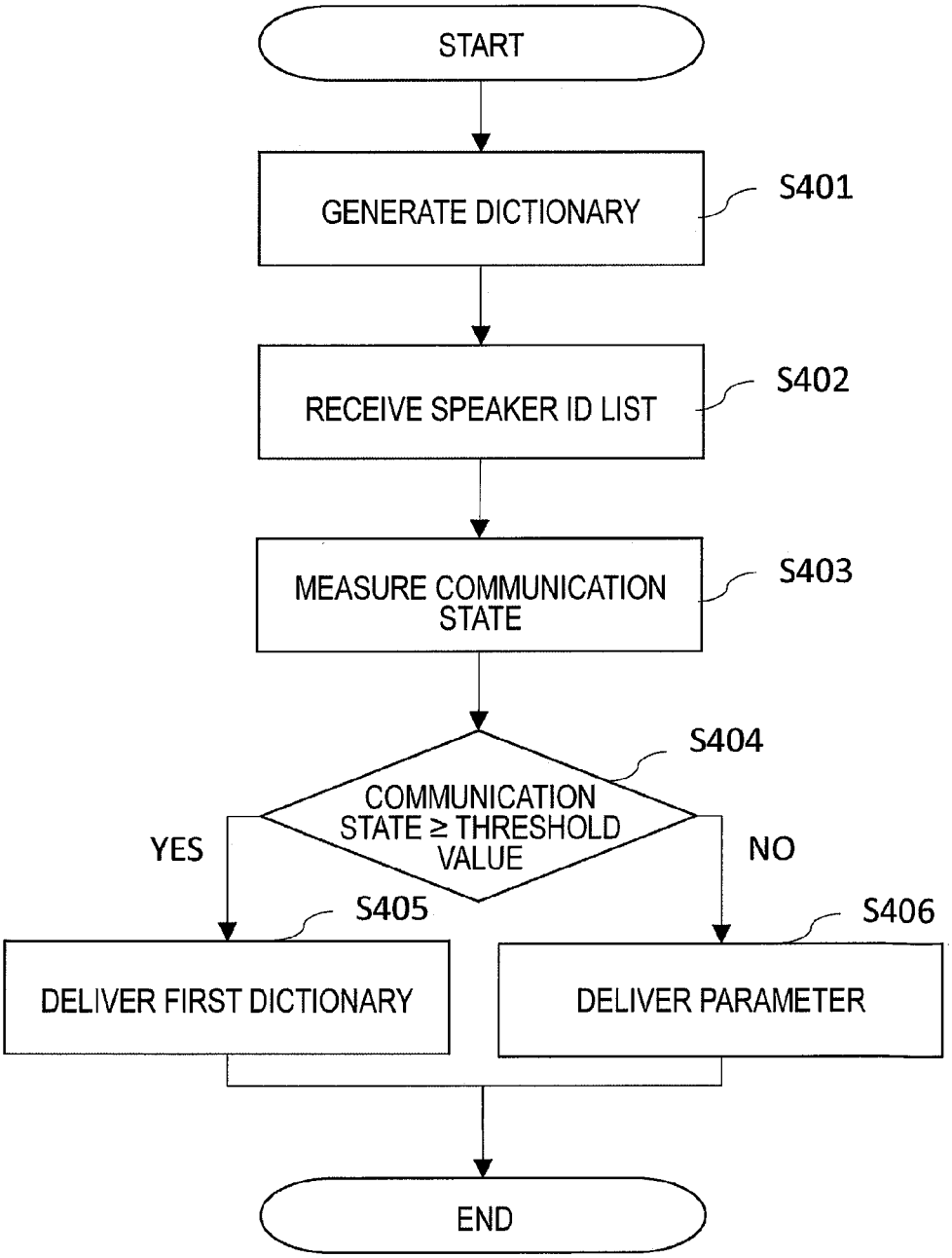
FIG. 4 is a process flow of dictionary delivery of the dictionary delivery server 100 according to the first embodiment.

FIG. 4 is a process flow of dictionary delivery in the dictionary delivery server 100 according to the present embodiment. First, for example, when the user activates or logs in the system of the present embodiment, the first dictionary generating unit 102 and the second dictionary generating unit 103 in the dictionary delivery server 100 generate dictionaries with reference to the speaker DB 101 (S401). The dictionary generation will be described later in detail. Then, the transceiving unit 107 of the dictionary delivery server 100 receives dictionary delivery requests from the terminal 110 (S402). In a dictionary delivery request, the terminal 110 transmits the speaker ID of the speaker whose voice is to be synthesized, to the dictionary delivery server 100. For example, in a case in which the voices of 1,000 speakers are synthesized in the terminal 110, the dictionary delivery server 100 receives 1,000 speakers' IDs. Then, the communication state measuring unit 106 measures the communication state between the dictionary delivery server 100 and the terminal 110 (S403). Here, the communication state is an index used in determination in the condition determining unit 104, and includes, for example, a communication speed of the network, a measured value of the communication volume on the network, or the like. Any index can be used as long as it can determine the communication state.

Then, the condition determining unit 104 determines whether or not the communication state measured in S403 is equal to or larger than a threshold value (S404). In a case in which the communication state is equal to or larger than the threshold value, i.e. judged as "good", for each received speaker ID (YES in S404), the first dictionary is delivered to the terminal 110 through the transceiving unit 112. In a case in which the communication state is less than the threshold value, i.e. judged as "bad", (NO in S404), the parameter set is delivered to the terminal 110, instead of the first dictionary, through the transceiving unit 112. Since the parameter set is smaller than the dictionary in terms of data size, the communication volume can be reduced. Then, the process of the dictionary delivery server 100 ends.

Figure 5:
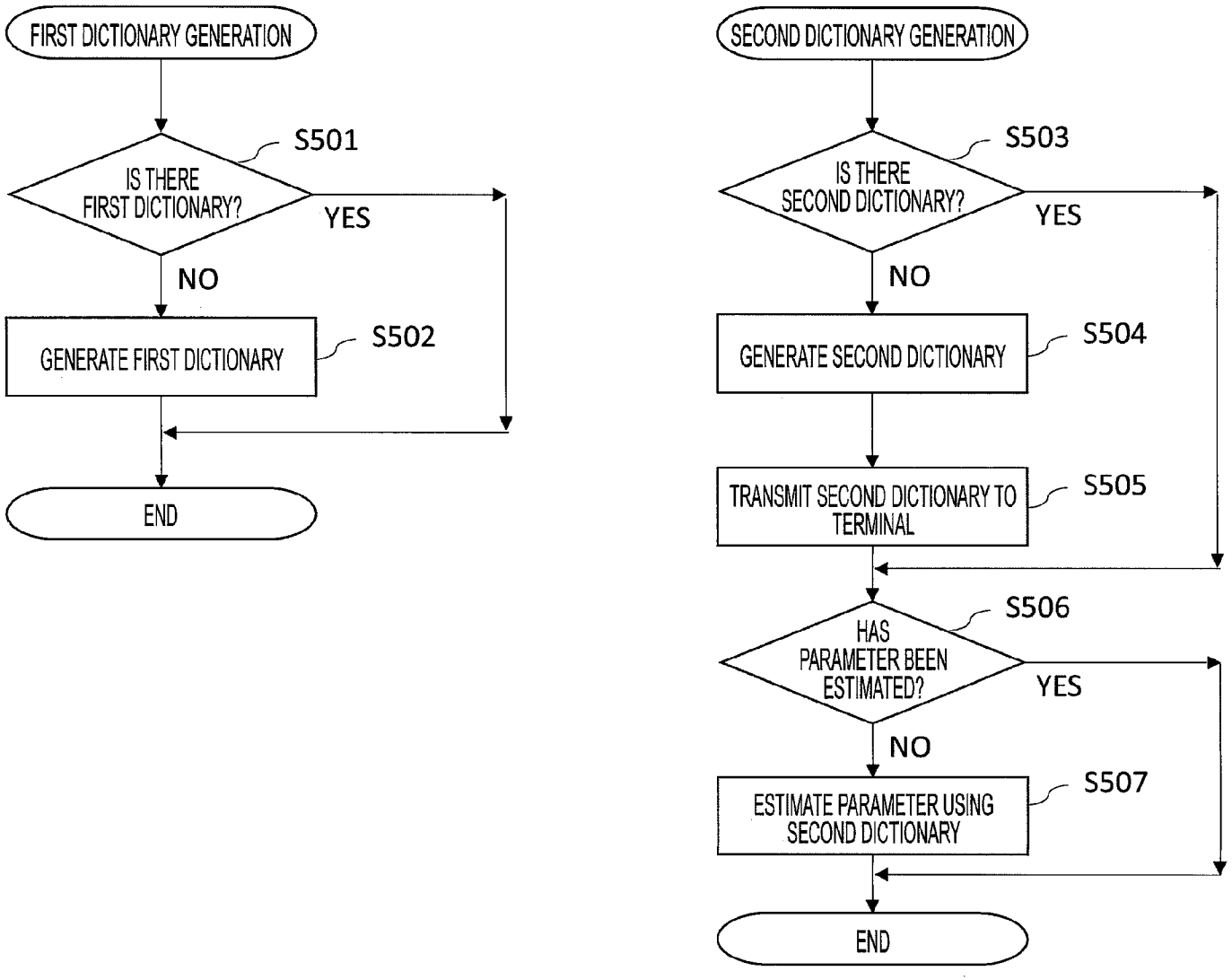
FIG. 5 is a more detailed process flow of dictionary generation (S401) of the dictionary delivery server 100 according to the first embodiment.

FIG. 5 is a more detailed process flow of the process in the dictionary generation (S401) in the dictionary delivery server 100 according to the present embodiment. First, the first dictionary generating unit 102 of the dictionary delivery server 100 determines whether or not the first dictionary of each speaker exists (S501). If the first dictionary does not exist (NO in S501), the process proceeds to S502. Such a case could occur, for example, when there is a speaker whose first dictionary has not been generated yet among the speakers stored in the speaker DB 101, when a certain user uses the system of the present embodiment for the first time, or when a message "Generate the first dictionary again" is input through the input unit 111 of the terminal 110, or the like. In the case where the first dictionary exists (YES in S501), the process of generating the first dictionary ends. Such a case could occur, for example, when the user has previously used the system and the first dictionary of the target speaker has already been generated.

In S502, the first dictionary generating unit 102 generates the first dictionary of the speaker from the recorded voices of the speaker and the corresponding recording texts with reference to the speaker DB 101. Here, acoustic features are extracted from the recorded voices, linguistic features are extracted from the recording texts, and an acoustic model, which represents a mapping from the linguistic features to the acoustic features, is learned. Then, the acoustic models for one or more acoustic features (for example, a spectrum, a pitch, a time length, or the like) are combined into one and used as the first dictionary. Since the details of the first dictionary generation method are generally known as the HMM speech synthesis (Non-Patent Document 1), a detailed description thereof is omitted here. The generated first dictionary is stored in the speech synthesis dictionary DB 105 in association with the speaker ID.

(Non-Patent Document 1) K. Tokuda "Speech Synthesis on the basis of Hidden Markov Models," in Proceedings of the IEEE, vol. 101, no. 5, pp. 1234-1252, 2013.

The recorded voices of the speaker are associated with the corresponding recording texts and stored in the speaker DB 101. For example, the speaker reads each recording text displayed on a display unit (not illustrated in FIG. 1) of the terminal 110, and the voices read by the speaker are acquired through the input unit 111 (for example, a microphone, or a voice sensor). Then, the acquired voices are transmitted to the dictionary delivery server 100 via the transceiving unit 112 and the network 120, and are stored in the speaker DB 101 in association with the recording texts. Alternatively, the voice may be directly acquired through an input unit (not illustrated in FIG. 1) of the dictionary delivery server 100. This input unit is another one from the input unit 111 but basically similar (i.e. a microphone, or a voice sensor, for example) Here, a set of prepared texts may be stored in the speaker DB 101 or in the terminal 110 as the recording texts in advance. Alternatively, the recording texts may be input by a speaker or a system administrator or the like, using the input unit 111 of the terminal 110 or an input unit (not illustrated in FIG. 1) of the dictionary delivery server 100. Further, voice recognition may be performed so that an acquired voice is converted into a text and used as a recording text. Then, the first dictionary generation process ends.

Next, the generation of the second dictionary will be described. First, for example, when the user activates or logs in the system of the present embodiment, the second dictionary generating unit 103 in the dictionary delivery server 100 determines whether or not there is the second dictionary (S503). In a case in which there is the second dictionary (YES in S503), the process proceeds to S506.

In a case in which there is no second dictionary (No in S503), the second dictionary generating unit 103 generates the second dictionary (S504). Here, for example, the acoustic features of a plurality of speakers stored in the speaker DB 101 are used. Unlike the first dictionary which is generated for each speaker, the second dictionary is a single one. Since several methods such as the eigenvoice (Non-Patent Document 2), the multiple regression HSMM (Non-Patent Document 3), and the cluster adaptive training (Non-Patent Document 4) are known as the method for generating the second dictionary, a description is omitted here.

(Non-Patent Document 2) K. Shichiri et al. "Eigenvoices for HMM-based speech synthesis," in Proceedings of ICSLP-2002.

(Non-Patent Document 3) M. Tachibana et al. "A technique for controlling voice quality of synthetic speech using multiple regression HSMM," in Proceedings of INTERSPEECH 2006.

(Non-Patent Document 4) Y. Ohtani et al. "Voice quality control using perceptual expressions for statistical parametric speech synthesis on the basis of cluster adaptive training," in Proceedings of INTERSPEECH 2016.

Preferably, the acoustic features of the speakers used for generating the second dictionary are included in a well-balanced manner in accordance with genders, ages, or the like. For example, attributes including the gender and the age of each speaker are stored in the speaker DB 101. The second dictionary generating unit 103 may select the speakers whose acoustic features are to be used, so that there is no bias in an attribute, with reference to the attributes of the speakers stored in the speaker DB 101. Alternatively, the system administrator or the like may generate the second dictionary in advance, using the acoustic features of the speakers stored in the speaker DB 101 or the acoustic features of speakers, which are prepared separately. The generated second dictionary is stored in the speech synthesis dictionary DB 105.

Then, the generated second dictionary is transmitted to the terminal 110 (S505). After this is done once, it is only required to deliver the parameter set of the speaker to synthesize a new speaker's voice with the second dictionary. Then, the second dictionary generating unit 103 determines whether or not the parameter set has been estimated for each speaker stored in the speaker DB (S506). In a case in which the parameter set has been estimated (YES in S506), the second dictionary generation process ends. In a case in which the parameter set has not been estimated (NO in S506), the second dictionary generating unit 103 estimates the parameter set of the speaker using the second dictionary (S507). Then, the second dictionary generation process ends.

Although the details of the parameter estimation differ depending on the method of generating the second dictionary, a detailed description is omitted because it is well known. For example, in a case in which the eigenvoice is used for generating the second dictionary, the eigenvalues of the respective eigenvectors are used as the parameter set. The estimated parameter set is stored in the speech synthesis dictionary DB 108 in association with the speaker ID. Here, in a case in which the eigenvoice is used as the method of generating the second dictionary, the meaning of each axis of the seven-dimensional vector is generally not interpretable by humans. However, in a case in which the multiple regression HSMM or the cluster adaptive training is used, for example, each axis of the seven-dimensional vector can have a meaning which can be interpreted by humans such as brightness and softness of a voice. In other words, a parameter is a coefficient indicating a feature of the voice of the speaker. The parameter set can be anything as long as it can approximate the voices of the speakers well when applied to the second dictionary.

The second dictionary may be updated at the timing when the number of speakers increases by a certain number or may be updated at regular time intervals. At that time, it is necessary to readjust the parameter sets. The readjustment of the parameter could be made to the parameters of all the speakers, or by properly managing the versions of the second dictionary and the parameters, it could be also possible to use compatible combinations of them.

As described above, in the case of the first dictionary, since its acoustic model is learned dedicatedly for each speaker, it has an advantage of high speaker reproducibility. However, a dictionary size per one speaker is large, and to enable to use many speakers in an application, it is necessary to deliver as many dictionaries as the number of required speakers to the terminal in advance. On the other hand, in the case of the second dictionary, since the synthetic speech of an arbitrary speaker can be generated by inputting the parameter set with the single second dictionary, it has an advantage that the size of the data needed to be delivered per speaker is small. Further, if the second dictionary has been transmitted to the terminal in advance, it is possible to synthesize the speech of a plurality of speakers on the terminal just by transmitting only a parameter set having a very small size. However, since a parameter set merely gives a rough approximation, the speaker reproducibility may be lower than that of the first dictionary. According to the present embodiment, adaptively using the first dictionary and the second dictionary each having a different characteristic, it is possible to obtain the synthesis voices of a plurality of speakers, independently of the hardware specification of the terminal.

Figure 6:
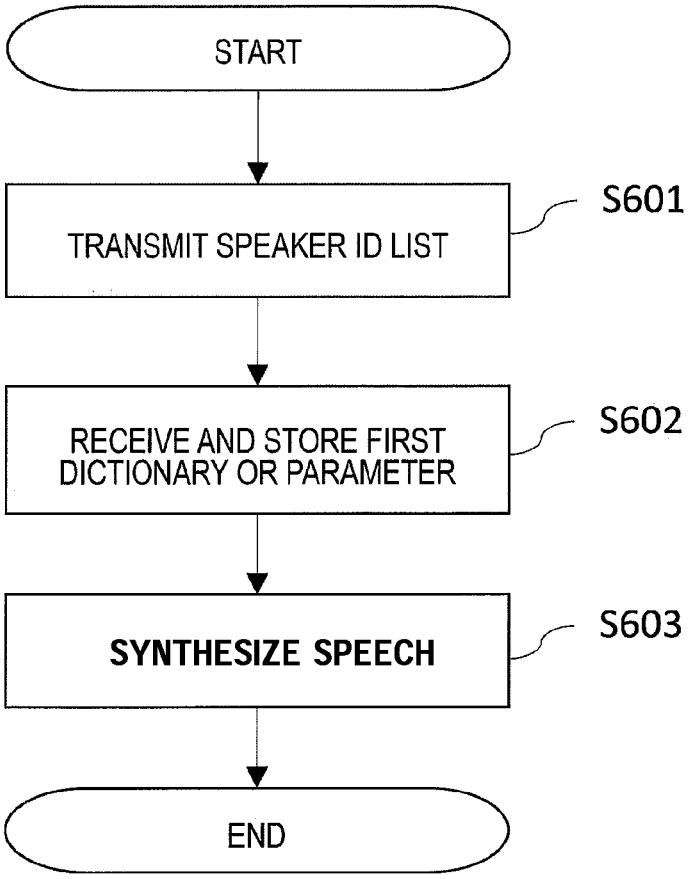
FIG. 6 is a process flow of the terminal 110 according to the first embodiment.

FIG. 6 is a process flow of the terminal 110 according to the present embodiment. First, the terminal 110 transmits the speaker ID to the dictionary delivery server 100 for the speaker whose voice is desired to be synthesized to make a dictionary delivery request (S601). The transceiving unit 112 of the terminal 110 receives the first dictionary or the parameter set transmitted from the dictionary delivery server 100 on the basis of the measurement result of the communication state of the current network and stores the first dictionary or the parameter set in the speech synthesis dictionary DB 114 (S602). The process so far requires the terminal to be connected to the network, and an appropriate dictionary is delivered in accordance with the communication state of the network. Then, the speech synthesis is performed (S603). At the timing of the speech synthesis process, it is assumed that the terminal has already received the first dictionary, the second dictionary, and the parameter set, so the speech synthesis process can be performed even though there is no connection with the network.

Figure 7:
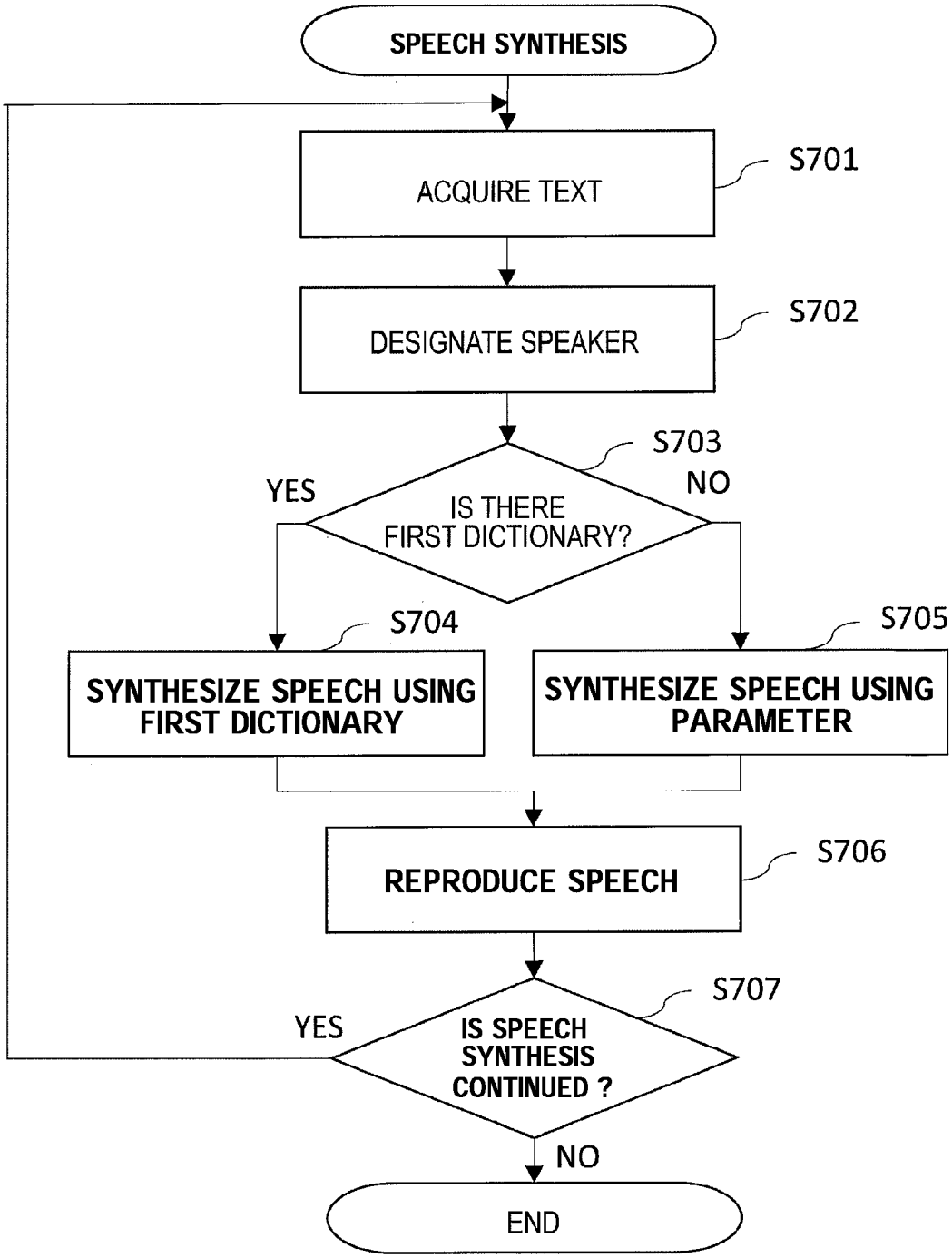
FIG. 7 illustrates a more detailed process flow of speech synthesis (S603) of the terminal 110 according to the first embodiment.

FIG. 7 is a more detailed process flow of the process of the speech synthesis (S603) of the terminal 110 according to the present embodiment. First, the terminal 110 acquires the text to be synthesized from the input unit 111 (S701). Here, for example, the user may input the text which is wished to be synthesized or may simply select the text which is desired to be synthesized in an application such as an SNS. Then, the speaker whose voice is desired to be synthesized is designated (S702). Here, for example, a scheme in which the user selects a speaker from a speaker list may be used, or if the text and the speaker are associated in advance, the associated speaker may be automatically designated.

Then, the dictionary managing unit 113 determines whether or not the first dictionary has already been delivered with reference to the speech synthesis dictionary DB 114 (S703). If the first dictionary has already been delivered (YES in S703), the synthesizing unit 115 synthesizes the speech using the first dictionary (S704). If only the parameter set has been delivered instead of the first dictionary (NO in S703), the synthesizing unit 115 synthesizes the speech using the second dictionary and the parameter set (S705). In a case in which both the first dictionary and the parameter set have been delivered, a priority is given to the first dictionary with the high speaker reproducibility. Here, for example, in a case in which the hardware specification of the terminal (for example, the memory onto which the dictionary is loaded) is insufficient, the parameter set may be given a priority.

At this stage, it is assumed that the first dictionary or the parameter set has already been delivered for each of all the speakers who are desired to be used, but in a case in which neither the first dictionary nor the parameter has been delivered for some speakers, a queue of such speakers may be prepared so that a necessary speaker should be downloaded automatically when a connection with the network is established next time. Further, in a case in which the communication state is very good, and a continuous connection is expected, a configuration in which the server side synthesizes the speech and then delivers only the synthesized speech without the first dictionary may be also used.

Then, the output unit 116 plays the speech synthesized by the synthesizing unit 115 (S706). Then, the input unit 111 receives a request signal of whether or not the speech synthesis should be continued (S707). For example, in a case in which the user is not satisfied with the current synthetic speech or desires to acquire the synthetic speech of another speaker, the user inputs a request signal indicating to "continue speech synthesis" through the input unit 111 (YES in S706). If the input unit 111 acquires the request signal indicating to "continue speech synthesis", the process proceeds to S701. On the other hand, the user may input a request signal indicating to "terminate the system" through the input unit 111 (NO in S706). If the input unit 111 receives the request signal indicating to "terminate the system", the speech synthesis processing ends. Here, even in a case in which there is no user operation for a certain period of time or more, the speech synthesis process may end. Further, when the user inputs the request signal, for example, a selection button may be provided on a display unit (not illustrated in FIG. 1) of the terminal 110, and the request signal may be input by tapping the selection button.

The speech synthesis dictionary delivery system according to the present embodiment is a system in which the first dictionary (only the voice of one speaker can be synthesized using one dictionary, and the first dictionary has the high speaker reproducibility) and the second dictionary (the voices of a plurality of speakers can be synthesized using one dictionary, and the second dictionary has the lower speaker reproducibility than the first dictionary) are dynamically switched on the basis of the communication state of the network connecting the server and the terminal, and the dictionary is delivered to the terminal. Accordingly, in a case in which the communication state is good, the system delivers the first dictionary with high speaker reproducibility but requiring a large communication volume per speaker, and in a case in which the communication state is bad, the system delivers only the speaker parameter set of the second dictionary having the lower speaker reproducibility but requiring only a small communication volume. As a result, it is possible to synthesize the speech of a plurality of speakers on the terminal while maintaining the speaker reproducibility as high as possible.

According to the first embodiment, it is even possible to make a request for 1,000 speakers from the server in the input unit. In that case, it is possible to use a method of first downloading all the parameter sets with small sizes at once to synthesizing the voices using the combination of the parameter sets and the second dictionary, and gradually replacing them with the first dictionaries having higher speaker reproducibility, downloaded when the communication state becomes better. As a modification of the present embodiment, in addition to the communication state of the network, limitations of network usage amount of the user may be considered. For example, it is also possible to switch the first dictionary and the second dictionary in view of the network usage amount of the current month.

According to the first embodiment, even in the terminal with limited connection to the network, it is possible to synthesize the speech of a plurality of speakers on the terminal while maintaining the speaker reproducibility as high as possible.

Second Embodiment

Figure 8:
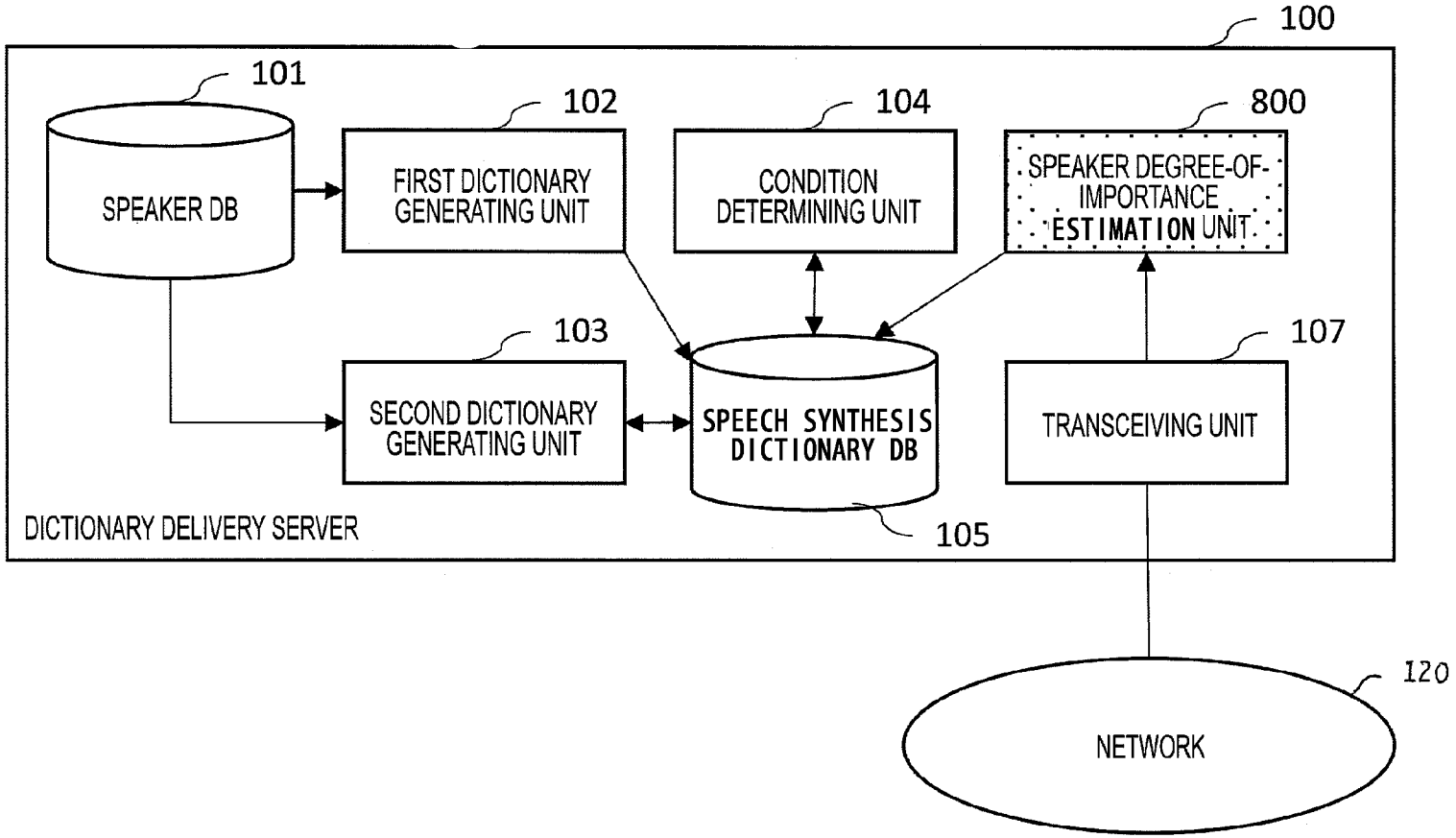
FIG. 8 is a block diagram of a dictionary delivery server 100 according to a second embodiment.

FIG. 8 is a block diagram of the dictionary delivery server 100 in the second embodiment. The same module as in the first embodiment is denoted by the same reference numeral. In the present embodiment, the communication state measuring unit 106 of the first embodiment is replaced with a speaker degree-of-importance estimating unit 800. The speaker degree-of-importance estimating unit 800 estimates the degree of importance of the speaker from the speaker and additional information requested by the terminal 110.

Figure 9:
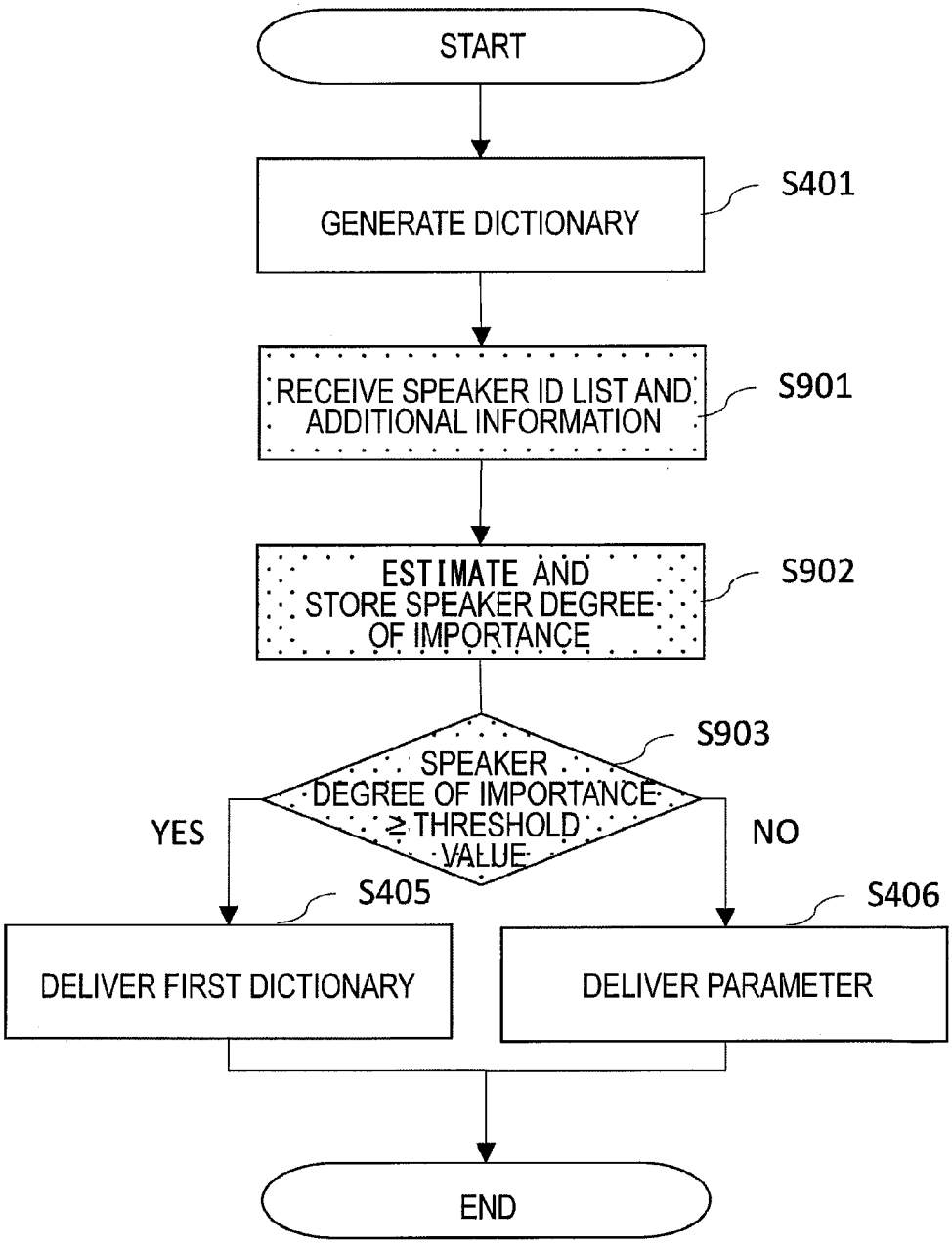
FIG. 9 is a process flow of dictionary delivery of the dictionary delivery server 100 according to the second embodiment.

FIG. 9 is a process flow of dictionary delivery of the dictionary delivery server 100 according to the present embodiment. The process flow of the dictionary generation, the process flow of the terminal, and the process flow of the speech synthesis are the same as in the first embodiment and thus omitted here. The same steps as in the first embodiment are denoted by the same step numbers. A different point lies in that the transceiving unit 107 receives additional information necessary for estimating the degree of importance in addition to the speaker ID from the terminal 110 of the user (S901), and the speaker degree-of-importance estimating unit 800 estimates the degree of importance between the user and each speaker using the received additional information (S902). The estimated speaker degree of importance is stored in a speech synthesis dictionary DB 108. Since the speaker degree of importance differs depending on the user, it is necessary to store the speaker degree of importance for each user. Then, the condition determining unit 104 uses the speaker degree of importance as a condition for deciding one of the first dictionary and the parameter to be delivered (S903). For example, in a case in which the speaker degree of importance is equal to or larger than a threshold value designated in advance (YES in S903), the first dictionary is delivered (S405), and in a case in which the speaker degree of importance is less than the threshold value (No in S902), the parameter is delivered (S406). Accordingly, the process flow of the dictionary delivery of the dictionary delivery server 100 according to the present embodiment ends.

The speech synthesis dictionary DB 105 further stores a speaker degree-of-importance table 1001 which is a data table in which the speaker degree of importance of each user is held. An example of the speaker degree-of-importance table 1001 is illustrated in FIG. 10. The speaker degree-of-importance table 1001 at least stores a speaker ID 1002 and a speaker degree of importance 1003 of each user in association with each other. In this example, the speaker degree of importance is indicated by numerical value in a range of 0 to 100, and as the value increases, the degree of importance of the speaker is determined to be more important.

For example, for a user 1, the speaker degrees of importance of a speaker 1, a speaker 2, and a speaker 4 are 100, 85, and 90, respectively, the speaker 1, the speaker 2, and the speaker 4 are more important speakers to the user 1, but the other speakers are not so important. If a threshold value is set to 50, when the voices of the speaker 1, the speaker 2, and the speaker 4 are synthesized, the first dictionary with the high speaker reproducibility is delivered, and when the voices of the other speakers are synthesized, only the parameter is delivered, and the synthesis is performed using the second dictionary.

The method of estimating the speaker degree of importance greatly depends on an application. Here, as an example, reading of a timeline of an SNS is considered. As the premise, the speaker corresponding to the speech synthesis dictionary DB 105 of the server (which need not necessarily be a voice of himself/herself) is assumed to be registered for each of the users registered in the SNS. In such an application, the terminal preferably transmits follow user information and frequency information of the user who appears on the timeline to the server as the additional information. The dictionary delivery server can determine that the speaker degree of importance of the user followed by the user is high or determine that the user who frequently appears on the timeline is high in the speaker degree of importance. Further, instead of performing the automatic determination on the basis of such additional information, the user may directly designate the user who is considered to be important.

According to the second embodiment, even in the terminal with a limited connection to the network, it is possible to synthesize the speech of a plurality of speakers on the terminal while maintaining the speaker reproducibility which is considered to be important by the user as high as possible.

The speech synthesis dictionary delivery system according to the second embodiment is a system in which the first dictionary and the second dictionary are dynamically switched on the basis of the degree of importance of the speaker, and the dictionary is delivered to the terminal. Accordingly, it is possible to reproduce the voice of the speaker with the high degree of importance using the first dictionary having the large dictionary size but the high speaker similarity and reproduce the voices of the other speakers using the second dictionary having the small dictionary size but the low speaker similarity, and it is possible to synthesize the speech of a plurality of speakers on the terminal while maintaining the speaker reproducibility as high as possible.

Third Embodiment

Figure 11:
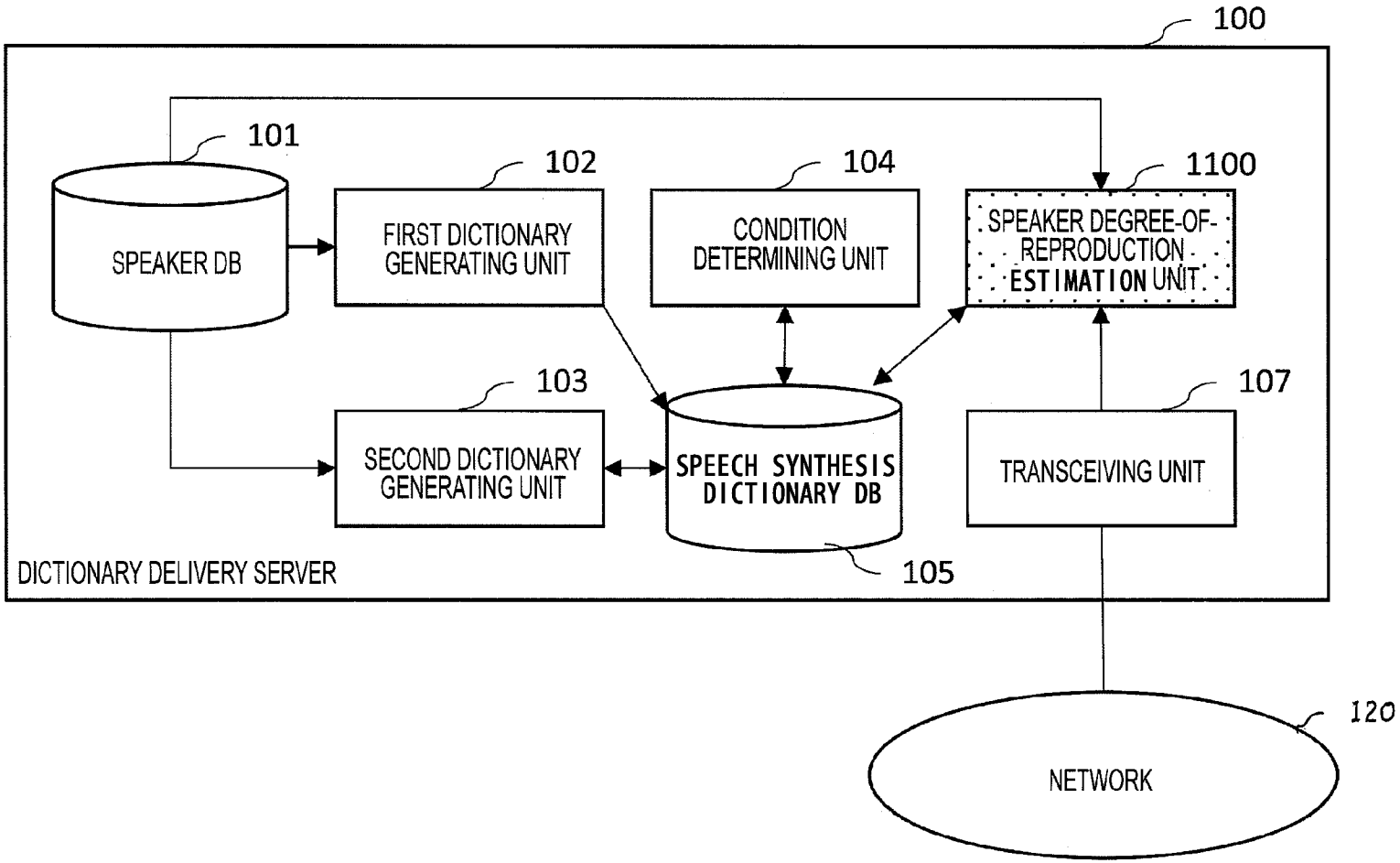
FIG. 11 is a block diagram of a dictionary delivery server 100 according to a third embodiment.

FIG. 11 is a block diagram of a dictionary delivery server 100 according to a third embodiment. The same module as in the first embodiment is denoted by the same reference numeral. In the present embodiment, the communication state measuring unit 106 of the first embodiment is replaced with a speaker degree-of-reproduction estimating unit 1100. The speaker degree-of-reproduction estimating unit 1100 estimates similarity between the synthetic speech generated from the parameter using the second dictionary of the speaker requested by the terminal and an original real voice.

Figure 12:
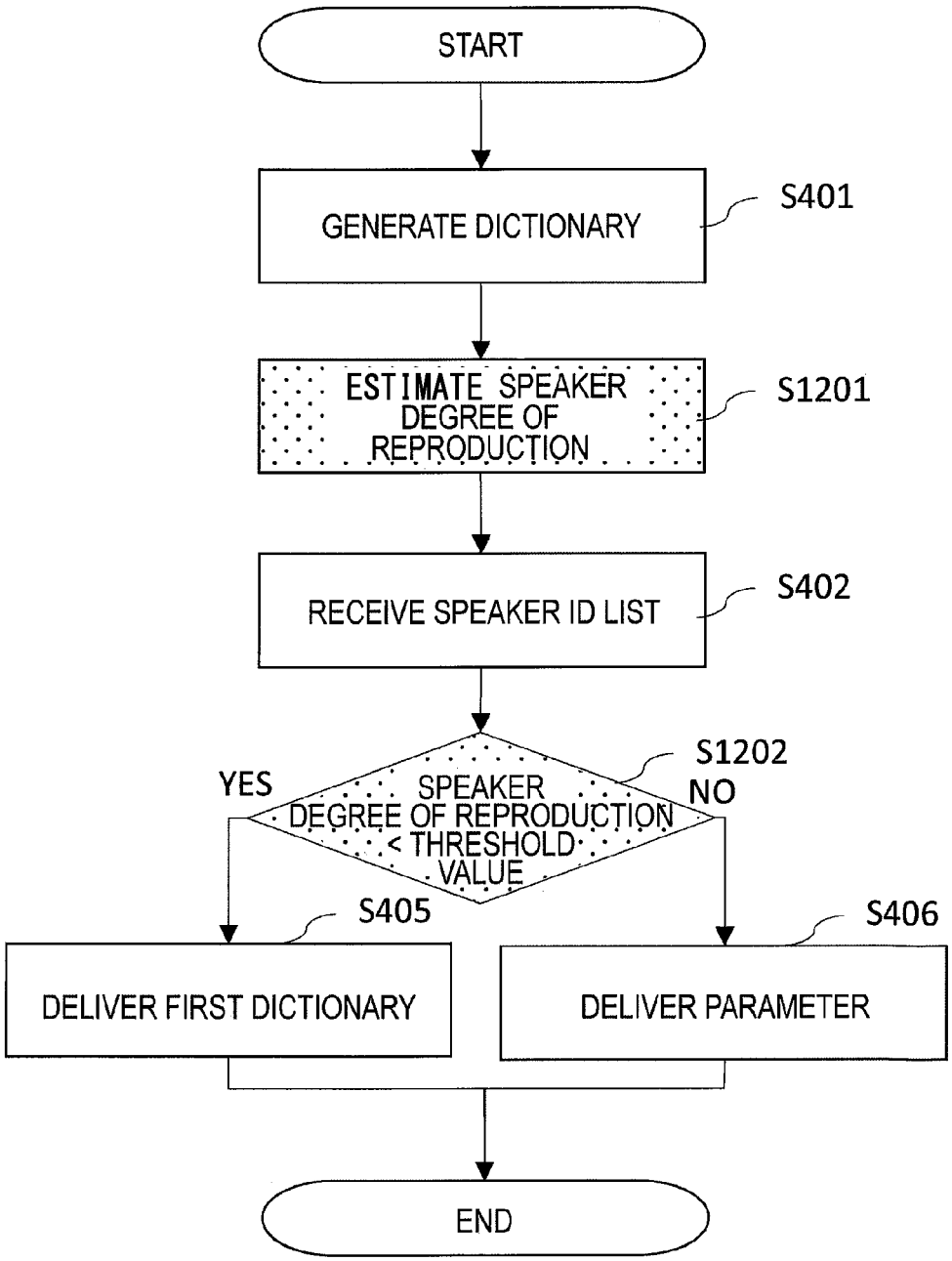
FIG. 12 is a process flow of dictionary delivery of the dictionary delivery server 100 according to the third embodiment.

FIG. 12 is a process flow of dictionary delivery of the dictionary delivery server 100 according to the present embodiment. The process flow of the dictionary generation, the process flow of the terminal, and the process flow of the speech synthesis are the same as in the first embodiment and thus omitted here. The same steps as in the first embodiment are denoted by the same step numbers. A different point lies in that the speaker degree-of-reproduction estimating unit 1100 estimates the speaker degree of reproduction of each speaker after the dictionary generation of the speaker (S401) (S1201). The speaker degree of reproduction is an index indicating similarity between the synthetic speech generated from the parameter using the second dictionary and the original real voice. The estimated speaker degree of reproduction is stored in the speech synthesis dictionary DB 105.

FIG. 14 shows an example of a speaker degree-of-reproduction table 1401 which is a data table in which the speaker degree of reproduction of each speaker is held. At least a speaker ID 1402 and a speaker degree of reproduction 1403 of each user are stored in the speaker degree-of-reproduction table 1401 in association with each other. In this example, the speaker degree of reproduction is indicated by a numerical value in a range of 0 to 100, and as the value increases, the speaker degree of reproduction is determined to be more higher. Then, the condition determining unit 104 uses the estimated speaker degree of reproduction as a condition for determining one of the first dictionary and the parameter to be delivered (S1202).

For example, in a case in which the speaker degree of reproduction is smaller than a threshold value designated in advance (YES in S1202), the first dictionary is delivered (S405) since sufficient reproduction is unable to be performed using the second dictionary and the parameter, and in a case in which the speaker degree of reproduction is equal to or larger than the threshold value (No in S1202), the parameter is delivered (S406) since sufficient approximation can be performed using the parameter. For example, in the example of FIG. 14, in a case in which the threshold value is set to 70, a speaker 1, a speaker 5, and a speaker 9 whose speaker degree of reproduction is higher than the threshold value are sufficiently high in the degree of reproduction by the parameter, and thus the parameter is delivered. For the other speakers the sufficient speaker degree of reproduction is unable to be obtained using the parameter, and thus the first dictionary is delivered. Accordingly, the process flow of the dictionary delivery of the dictionary delivery server 100 according to the present embodiment ends.

Figure 13:
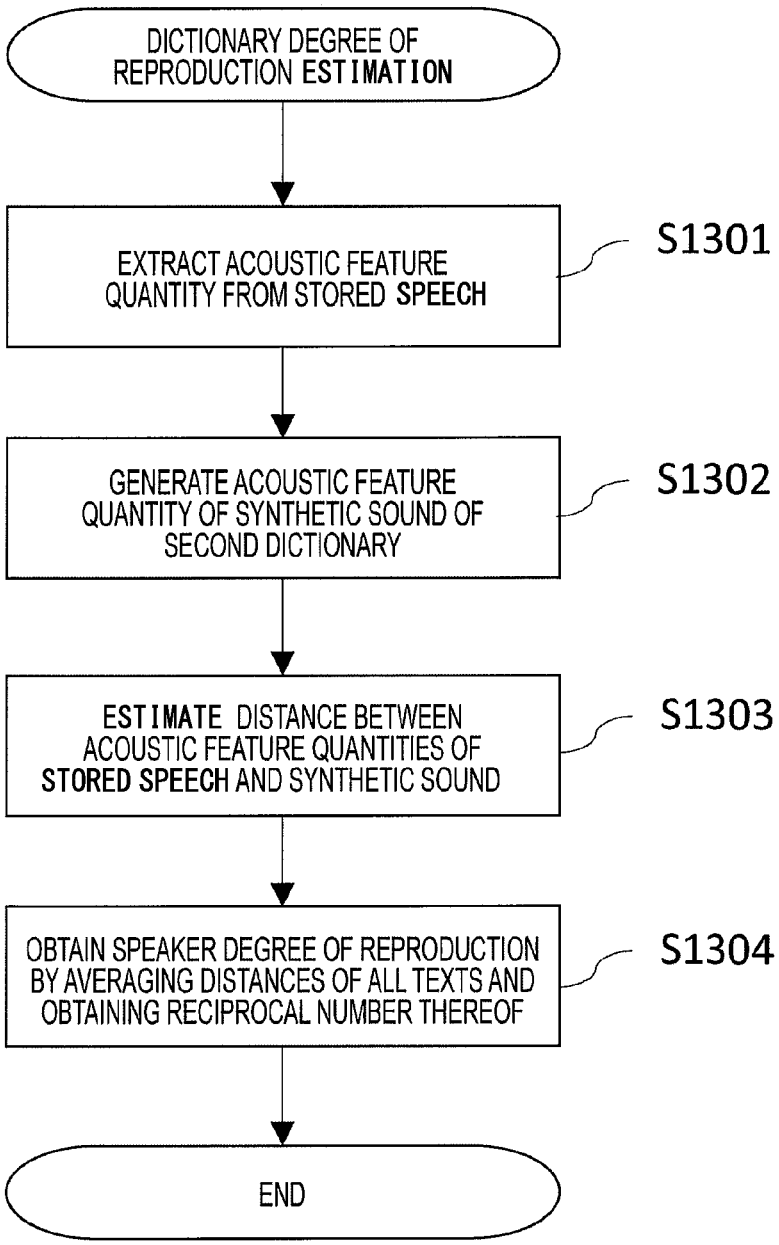
FIG. 13 illustrates an example of a speaker degree-of-reproduction table 1401 according to the third embodiment.

FIG. 13 is a process flow illustrating an example of a method of estimating the speaker degree of reproduction in S1201. First, in order to estimate the speaker degree of reproduction of each speaker, each acoustic feature quantity is extracted from the recorded voice corresponding to the recording text used by each speaker with reference to the speaker DB 101 (S1301). Examples of the acoustic feature quantity include a mel LSP indicating a voice tone, an LF0 indicating a height of a voice, and the like. Then, the acoustic feature quantity of the recording text used by each speaker is generated from the second dictionary and the parameters of each speaker (S1302). Since the acoustic feature quantities are desired to be compared here, it is not necessary to generate the synthetic speech from the acoustic feature quantity. Then, a distance between the acoustic feature quantity extracted from the real voice and the acoustic feature quantity generated from the second dictionary is obtained (S1303). For example, a Euclidean distance or the like is used. Finally, the distance is converted into a degree of similarity (the speaker degree of reproduction) by averaging the distances of all the texts and obtaining a reciprocal number thereof (S1304). As the speaker degree of reproduction increases, the similarity between the real voice of the original speaker and the synthetic speech generated from the second dictionary increases, and the real voice of the original speaker can be sufficiently reproduced on the basis of the second dictionary and the parameter.

Although the parameter estimated from the second dictionary is an approximation of the voice quality characteristic of the original speaker, it is understood that approximation accuracy differs depending on the speaker. It is understood that as the number of speakers having the similar voice quality in the speaker DB 101 used for generating the second dictionary increases, the approximation accuracy increases, and the speaker individuality of the target speaker can be sufficiently reproduced using the second dictionary and the parameter.

According to the third embodiment, even in the terminal having the limited connection to the network, it is possible to synthesize the speech of a plurality of speakers on the terminal since the parameter is transmitted for the speaker having the high speaker reproducibility, and thus the volume of the communication of the network is suppressed.

The speech synthesis dictionary delivery system according to the third embodiment is a system in which the first dictionary and the second dictionary are dynamically switched on the basis of the speaker reproducibility when the synthesis is performed using the second dictionary, and the dictionary is delivered to the terminal. Accordingly, it is possible to reproduce the voice of the speaker with the high speaker reproducibility in the second dictionary using the parameter with a small size and reproduce the voices of the other speakers using the first dictionary, and it is possible to synthesize the speech of a plurality of speakers on the terminal while maintaining the speaker reproducibility as high as possible.

Fourth Embodiment

Figure 15:
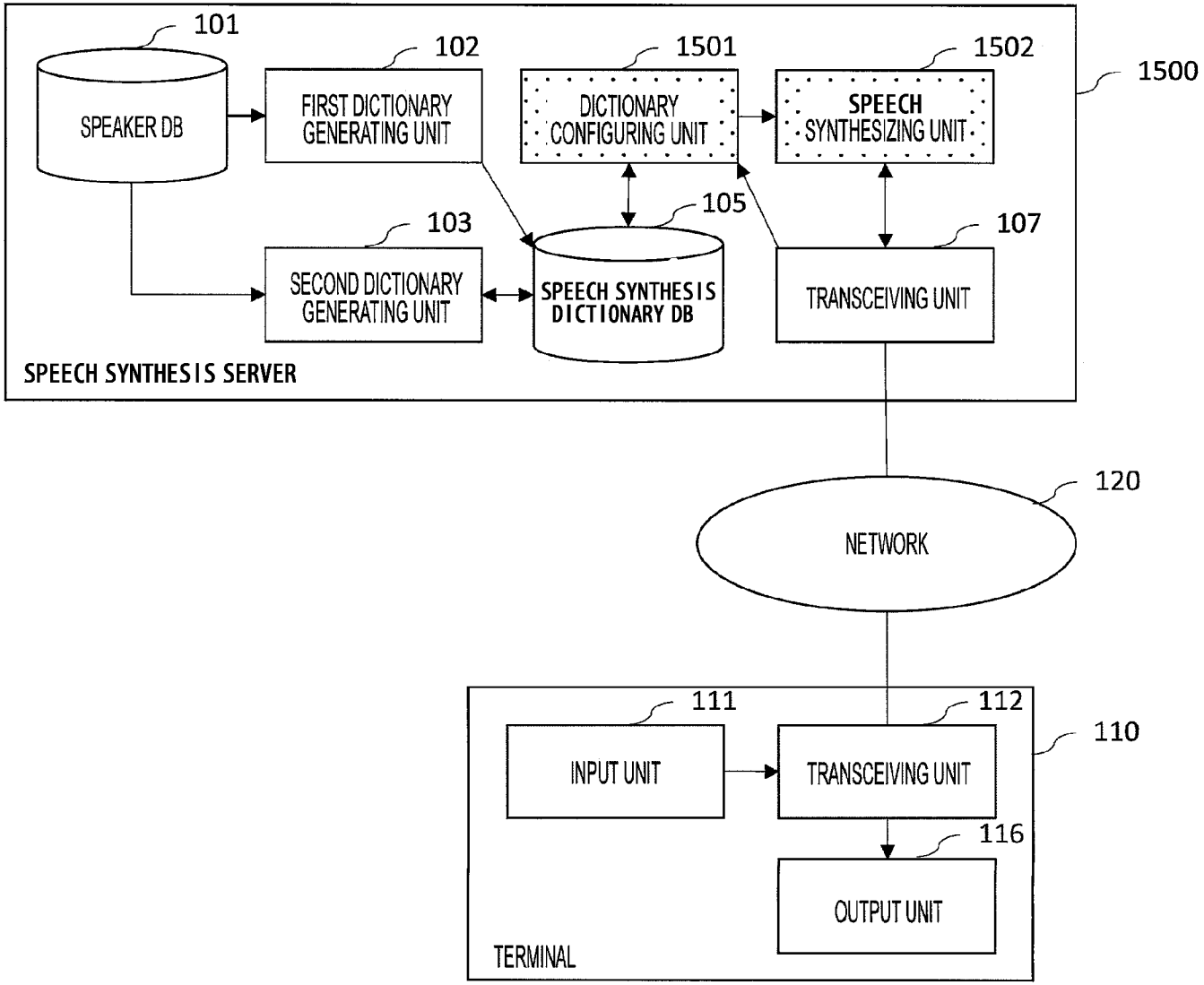
FIG. 15 is a block diagram illustrating a speech synthesis system according to a fourth embodiment.

FIG. 15 is a block diagram illustrating a speech synthesis system according to the present embodiment. The same module as in the first embodiment is denoted by the same reference numeral. In the present embodiment, the synthesizing unit 115 installed on the terminal 110 side is moved to the speech synthesis server 1500 side, and the condition determining unit 104 is replaced with a dictionary configuring unit 1501. The dictionary configuring unit 1501 dynamically switches an arrangement or a use of the first dictionary and the second dictionary on a memory in accordance with, for example, a server load of the speech synthesis server 1500 and the degree of importance of the speaker. A speech synthesizing unit 1502 delivers the synthesized speech using the first dictionary or the second dictionary to the terminal through the transceiving unit 107. In the present embodiment, the speech synthesizing unit 1502 exists in the speech synthesis server 1500 and not in the terminal 110. Thus, the synthesized speech received from the transceiving unit 112 via the network 120 is reproduced through the output unit 116.

Figure 16:
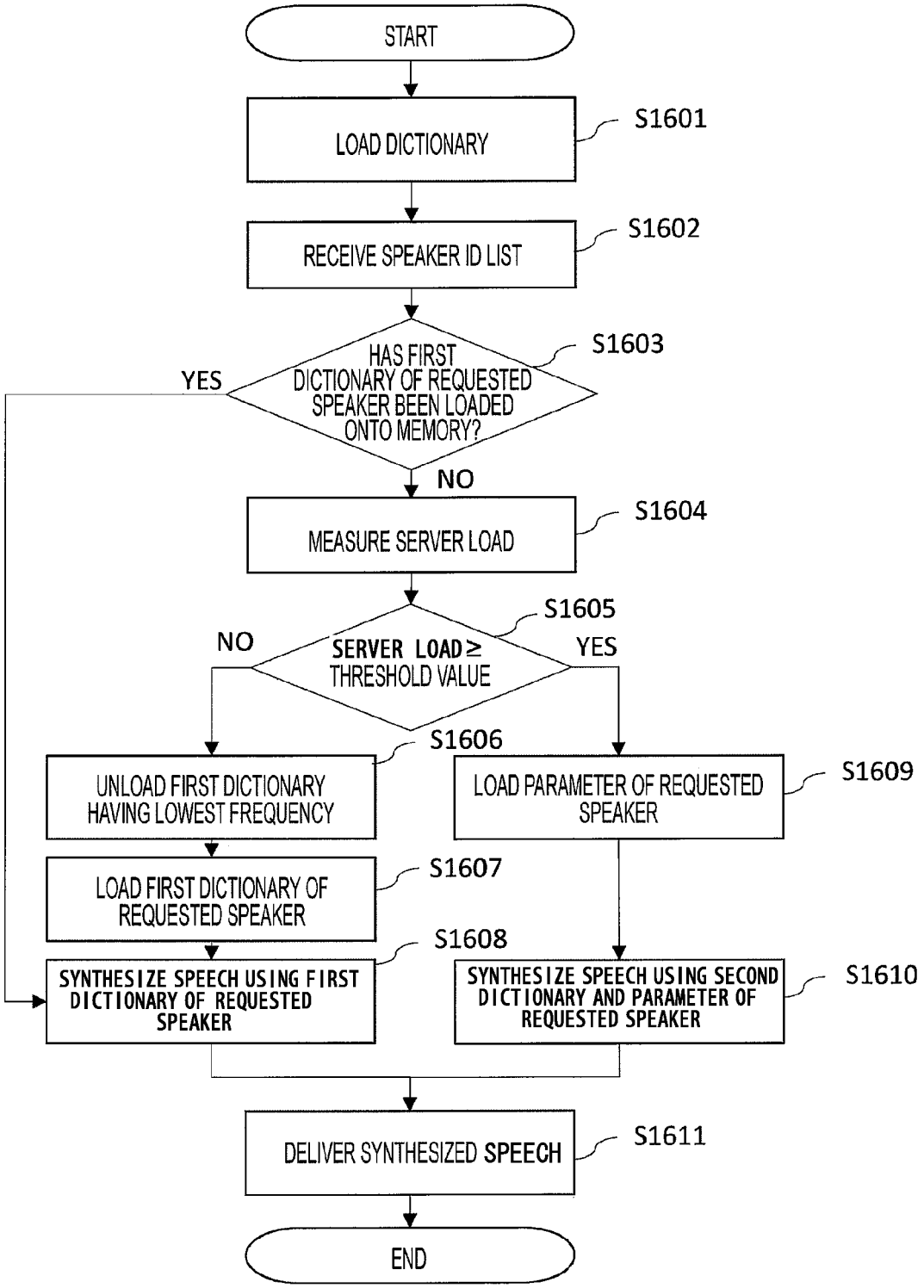
FIG. 16 is a process flow of a speech synthesis server 1500 according to the fourth embodiment.

FIG. 16 is a process flow of the speech synthesis server 1500 according to the present embodiment. Here, in the present embodiment, the first dictionary, the second dictionary, and the parameter of each speaker are assumed to be generated and stored in the speech synthesis dictionary DB 105 in advance. Alternatively, the first dictionary, the second dictionary, and the parameter of each speaker may be generated in accordance with the same flow as in the first embodiment before the dictionary loading (S1601) described later is started.

First, the dictionary configuring unit 1501 loads the dictionary of the speech synthesis dictionary DB 105 onto the memory of the speech synthesis server 1500 (S1601). Then, the transceiving unit 107 of the speech synthesis server 1500 receives the speech synthesis request from the terminal 110 (S1602). In the speech synthesis request, the terminal 110 transmits the speaker ID of the speaker whose voice is requested to be synthesized to the speech synthesis server 1500. Then, the dictionary configuring unit 1501 determines whether or not the first dictionary of the speaker requested from the terminal 110 has been loaded onto the memory (S1603). In a case in which the first dictionary of the speaker requested from the terminal 110 has been loaded onto the memory (YES in S1603), the speech synthesizing unit 1502 synthesizes the speech using the first dictionary (S1608). In a case in which the first dictionary of the speaker requested from the terminal 110 has not been loaded onto the memory (NO in S1603), the dictionary configuring unit 1501 measures the current server load (S1604). Here, the server load is an index used in the determination in the dictionary configuring unit 1501, and is measured on the basis of, for example, a free capacity of the memory in the speech synthesis server 1500, the number of terminals 110 connected to the speech synthesis server 1500, or the like. Any index can be used as long as it can be used to determine the server load.

In a case in which the server load is equal to or larger than a threshold value (YES in S1605), the dictionary configuring unit 1501 determines that the speech synthesis process using the first dictionary is unable to be performed, and loads the parameter of the speaker requested from the terminal (S1609), and the synthesizing unit 115 synthesizes the speech using the second dictionary and the parameter (S1610). In a case in which server load is smaller than the threshold value (NO in S1605), the dictionary configuring unit 1501 unloads the first dictionary having the lowest speaker request frequency (to be described later) from the memory because the first dictionary is unable to be loaded onto the memory any more (S1606). Then, a new first dictionary of the speaker requested from the terminal is loaded onto the memory (S1607), and the synthesizing unit 115 synthesizes the speech using the first dictionary loaded onto the memory (S1608). The speech synthesized using the first dictionary or the second dictionary is delivered from the server to the terminal through the transceiving unit 107 (S1611). Thus, the process flow of the speech synthesis server 1500 ends.

Figure 17:
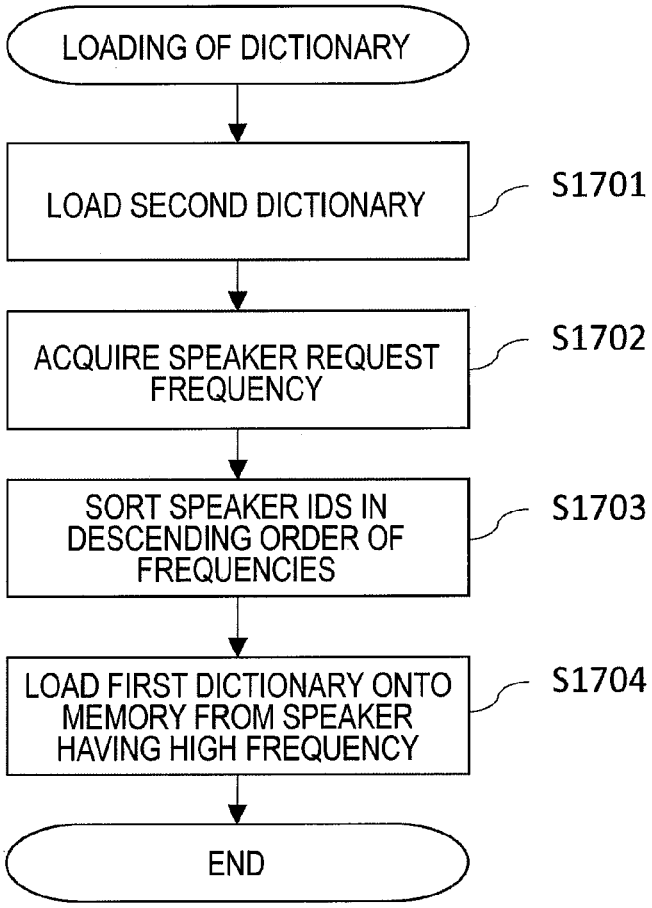
FIG. 17 is a more detailed process flow of dictionary loading (S1601) according to the fourth embodiment.

FIG. 17 is a process flow in which the process of loading a dictionary (S1601) is further refined. First, the second dictionary is loaded onto the memory in the speech synthesis server 1500 (S1701). Then, the speaker request frequency is acquired (S1702). The speaker request frequency is a data table indicating a frequency at which the speech synthesis request is made for each speaker, and an example of the speaker request frequency is illustrated in FIG. 18. In a speaker request frequency table 1801 illustrated in FIG. 18, at least a speaker ID and a request frequency (the number of speech synthesis requests transmitted from the terminal 110) 1703 are stored in association with each other. In the request frequency 1703, a count of the speaker requested is increased each time the speech synthesis request (S1602) is received from the user. In addition to the increasing of the count, it is possible to reset the frequency at regular intervals or to use a method in which the frequency gradually attenuates as time elapses, but it is omitted here.

Then, the speaker IDs are sorted in the descending order of the speaker request frequencies (S1703). Then, the first dictionary is loaded onto the memory from the speaker having the high speaker request frequency (S1704). Then, the process flow of loading the dictionary ends. Here, it is assumed that the first dictionaries of all the speakers stored in the speech synthesis dictionary DB 105 are unable to be loaded onto the memory. Therefore, since the speaker having the high speaker request frequency is preferentially loaded onto memory, the processing efficiency of the speech synthesis is increased.

The speech synthesis dictionary delivery system according to the fourth embodiment is a configuration in which the voice is synthesized on the server, and only the voice is delivered to the terminal, similarly to the system of the related art. Normally, in such a configuration, it is common to load the dictionary necessary for synthesis onto the memory in advance in order to improve the response of the server. However, in a case in which a plurality of speakers are provided on the server, it is difficult to load all the dictionaries of the speakers onto the memory from a viewpoint of the hardware specification.

According to the fourth embodiment, the response of the server and the speaker reproducibility are improved by dynamically switching the use of the first dictionary and the second dictionary to be loaded onto the memory in accordance with the degree of importance of speaker, and thus it is possible to synthesize the speech of a plurality of speakers.

Here, each functional components of the dictionary delivery server described in the embodiments, can be implemented by cooperation of hardware such as a general computer with a computer program (software). For example, by executing a certain computer program on the computer, each of the components, such as the first dictionary generating unit 102, the second dictionary generating unit 103, the condition determining unit 104, and the communication state measuring unit 106 shown in FIG. 1 can be implemented. Using a storage device included in the computer, the speaker DB 101 and the speech synthesis dictionary DB 105 are implemented. In addition, using a communication interface (I/F) included in the computer the transceiving unit 107 is implemented.

Figure 19:
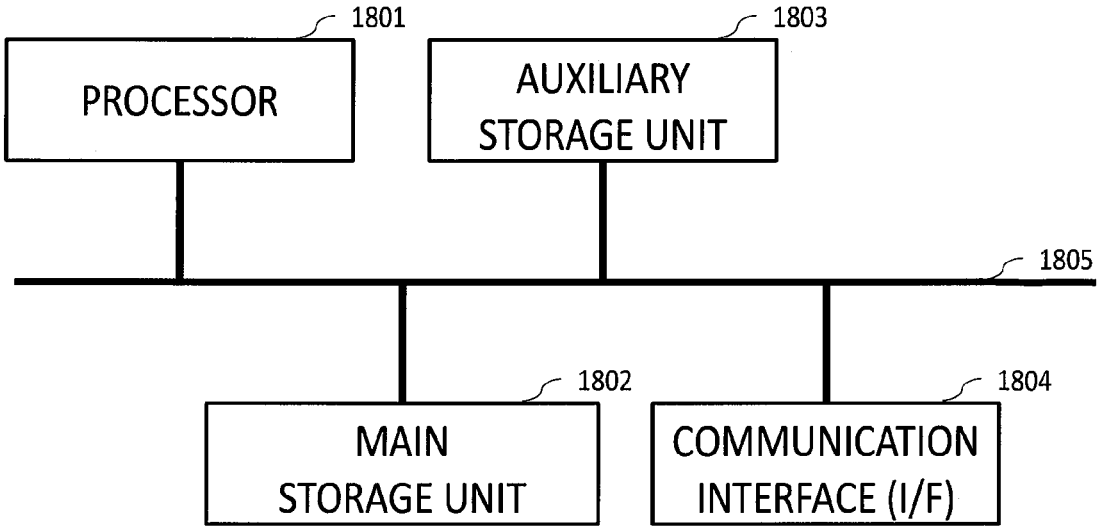
FIG. 19 is a block diagram schematically illustrating exemplary hardware structure of the dictionary delivery server according to the embodiments.

FIG. 19 is a block diagram schematically illustrating an exemplary hardware structure of the major part of the dictionary delivery server 100.

As illustrated in FIG. 19, the major part of the dictionary delivery server 100 is structured as a general purpose computer system that includes a processor 1801 such as a CPU, a main storage unit 1802 such as a random access memory (RAM), an auxiliary storage unit 1803 using various storage devices, a communication interface 1804, and a bus 1805 connecting to the processor 1801, the main storage unit 1802, auxiliary storage unit 1803, and the communication interface. Here, the auxiliary storage unit 1803 may be directly or indirectly connected to the other units with a local area network (LAN) in a wired or wireless manner, for example.

In detail, the functional components of the dictionary delivery server 100 can be implemented by the processor 1801 developing and executing a program stored in a ROM (exemplarily included in the server 100) on the main storage unit (RAM) 1802, for example. The program also may be provided as a computer program product which is recorded on a computer-readable recording medium such as a compact disc read only memory (CD-ROM), a flexible disk (FD), a compact disc recordable (CD-R), and a digital versatile disc (DVD), as an installable or executable file, for example.

The program also may be stored in another computer connected to a network such as an internet and provided by being downloaded via the network. The program may be provided or distributed via a network such as an internet. The program may be pre-embedded or preinstalled in the ROM in the computer.

The program includes a module structure of the functional components (the first dictionary generating unit 102, the second dictionary generating unit 103, the condition determining unit 104, and the communication state measuring unit 106) of the dictionary delivery server 100. In actual hardware, the processor 1801 reads the program from the recording medium and executes the program. Once the program is loaded and executed, the components are formed in the main storage unit 1802. A whole or a part of the components of the dictionary delivery server 100 may include a dedicated hardware such as an application specific integrated circuit (ASIC) and a field-programmable gate array (FPGA).

The main storage unit 1802 stores the speaker DB 101 and the speech synthesis dictionary DB 105. Further, the communication I/F 1804 realizes the transceiving unit 107.

The dictionary delivery server 100 of the present embodiments may be configured as a network system in which a plurality of computers are communicably connected to each other and may be configured to implement the components being distributed to the plurality of the computers. The dictionary delivery server 100 of the present embodiment may be a virtual machine operating on a cloud system.

Further, the functional components in the terminal 110 according the embodiments can be similarly implemented by cooperation of hardware such as a general computer with a computer program (software) executed by the computer, for example. The program may include a module structure of the functional components (the input unit 111, the dictionary managing unit 113, the synthesizing unit 115, and the output unit 116) of the terminal 110. In actual hardware, a processor (not illustrated) reads the program from the recording medium and executes the program. Once the program is loaded and executed, the respective components are formed in the main storage unit (not illustrated).

The main storage unit stores the speech synthesis dictionary DB 114. Further, the communication I/F realizes the transceiving unit 112.

The techniques described in the above embodiments can be stored in a storage medium such as a magnetic disk (floppy (registered trademark) disk, a hard disk, or the like), an optical disk (a CD-ROM, a DVD or the like), a magneto-optical disk (MO), or a semiconductor memory as a computer executable program and distributed.

Here, any form can be used as a storage form of the storage medium as long as it is a computer readable storage medium which can store a program.

Further, an operating system (OS) operating on a computer on the basis of instructions of a program installed in a computer from a storage medium or middleware (MW) such as database management software or network software may execute a part of each process for implementing the present embodiment.

Further, the storage medium according to the present embodiments are not limited to a medium independent of a computer and may also include a storage medium in which a program transmitted via a LAN, the Internet, or the like is downloaded and stored or temporarily stored.

Further, the number of storage media is not limited to one, and even in a case in which the process according to the present embodiments are executed from a plurality of media is included in the storage medium of the present embodiment, and a medium configuration is not particularly limited.

Here, the computer of the present embodiment refers to one which executes each process of the present embodiment on the basis of a program stored in the storage medium and may have any configuration such as a system in which a single device such as a personal computer or a plurality of devices are connected to a network.

Further, each storage device of the present embodiments may be implemented by one storage device or may be implemented by a plurality of storage devices.

Further, the computer of the present embodiment is not limited to a personal computer and includes an operation processing device, a microcomputer, or the like included in an information processing device, and collectively refers to a device or an apparatus capable of implementing the function of the present embodiment in accordance with a program.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A speech synthesis dictionary delivery device that delivers a dictionary for performing speech synthesis to a terminal via a network, comprising:

a storage device for a speech synthesis dictionary database configured to:

store first dictionaries, each of which includes an acoustic model of a speaker and is associated with identification information of the speaker;

store a second dictionary that includes a versatile acoustic model generated using voice data of a plurality of speakers; and store parameter sets of the speakers to be used with the second dictionary and that are associated with identification information of the speakers;

a processor configured to determine one of a first dictionary and the second dictionary, which should be used in the terminal for a specified speaker, based on a communication state of the network; and an input output interface (I/F) configured to:

receive identification information of the specified speaker transmitted from the terminal via the network; and deliver the first dictionary, or at least one of the second dictionary and a parameter set of the second dictionary to the terminal via the network, based on the received identification information of the specified speaker and a result of the determination by the processor.

2. The speech synthesis dictionary delivery device according to claim 1, wherein, after the second dictionary has been transmitted to the terminal, the input output interface is configured to deliver the first dictionary or the parameter set of the second dictionary based on the received identification information of the specified speaker and the result of the determination.

3. The speech synthesis dictionary delivery device according to claim 1, wherein the processor is further configured to:

measure the communication state of the network; and determine one of the first dictionary and the second dictionary to be used based on a result of the measurement.

4. The speech synthesis dictionary delivery device according to claim 1, wherein the processor is further configured to:

estimate a degree of importance of the specified speaker, and determine one of the first dictionary and the second dictionary to be used based on a result of the estimation.

5. The speech synthesis dictionary delivery device according to claim 1, wherein, when a hardware specification of the terminal is insufficient, the parameter set of the second dictionary is given a priority.

6. The speech synthesis dictionary delivery device according to claim 1, wherein the processor is further configured to:

compare acoustic features generated based on the second dictionary with acoustic features extracted from real voice samples of the specified speaker;

estimate a degree of reproducibility of a synthesized speech by the second dictionary; and determine one of the first dictionary and the second dictionary to be used based on a result of estimation of the degree of reproducibility.

7. A speech synthesis system that delivers a synthetic speech to a terminal via a network, comprising:

an input output interface (I/F) configured to receive identification information of a specified speaker transmitted from the terminal via the network;

a storage device for a speech synthesis dictionary database configured to:

store a first dictionaries, each of which includes an acoustic model of a speaker and is associated with identification information of the speaker;

store a second dictionary that includes a versatile acoustic model generated using voice data of a plurality of speakers; and store parameter sets of the speakers to be used with the second dictionary and is associated with identification information of the speakers;

a hardware processor configured to:

select a first dictionary or a parameter set to be loaded onto the storage device based on a server load of the speech synthesis system; and synthesize a speech using the first dictionary or the parameter set with the second dictionary that is selected by the hardware processor, wherein the input output interface is further configured to deliver the speech synthesized by the hardware processor to the terminal via the network.

8. The speech synthesis system according to claim 7, wherein the hardware processor is further configured to measure the server load of the speech synthesis system, wherein, when the measured server load is not larger than a threshold value, the first dictionary having the lowest usage frequency in loaded ones is unloaded from the storage device, and the first dictionary of the specified speaker requested from the terminal is loaded to the storage device.

9. The speech synthesis system according to claim 7 wherein the hardware processor is further configured to measure the server load of the speech synthesis system, wherein, when the measured server load is larger than a threshold value, the parameter set of the specified speaker requested from the terminal is loaded to the storage device.

10. A non-transitory computer-readable storage medium storing instructions that, when executed by one or more processors of a device having a speech synthesis dictionary delivery program stored therein, cause the device to:

store first dictionaries each of which includes an acoustic model of a speaker and is associated with identification information of the speaker;

store a second dictionary including a versatile acoustic model generated using voice data of a plurality of speakers;

store parameter sets of the speakers to be used with the second dictionary in association with identification information of the speakers;

determine which of a first dictionary and the second dictionary should be used for a specified speaker based on a communication state of a network connected to a terminal;

receive the identification information of the specified speaker transmitted from the terminal via the network; and deliver the first dictionary, or at least one of the second dictionary and a parameter set to the terminal via the network based on the received identification information of the specified speaker and a determination result by the determining.

11. A speech synthesis device that provides a synthetic speech to a terminal via the network, comprising:

a storage unit for a speech synthesis dictionary database configured to:

store first dictionaries each of which includes an acoustic model of a speaker and is associated with identification information of the speaker;

store a second dictionary having a versatile acoustic model that is generated using voice data of a plurality of speakers; and store parameter sets of the speakers to be used with the second dictionary in association with identification information of the speakers;

a condition determination unit configured to determine which of a first dictionary and the second dictionary should be used for a specified speaker based on a communication state of the network; and a transceiving unit configured to:

receive identification information of the specified speaker transmitted from the terminal via the network; and deliver the first dictionary or at least one of the second dictionary and a parameter set of the second dictionary to the terminal via the network based on the received identification information of the specified speaker and a result of the determination by the condition determination unit.

12. The speech synthesis device according to claim 11, wherein, after the second dictionary is transmitted to the terminal, the transceiving unit is further configured to deliver the first dictionary or the parameter set of the second dictionary based on the received identification information of the specified speaker and the result of the determination by the condition determination unit.

13. The speech synthesis device according to claim 11, further comprising:

a communication state measuring unit configured to:

measure the communication state of the network; and determine which of the first dictionary and the second dictionary should be used based on a result of the measurement.

14. The speech synthesis device according to claim 11, further comprising:

a speaker degree-of importance estimation unit configured to:

estimate a degree of importance of the specified speaker; and determine which of the first dictionary and the second dictionary should be used based on a result of the estimation.

15. The speech synthesis device according to claim 11, further comprising:

a speaker degree-of-reproducibility estimation unit configured to:

compare acoustic features generated based on the second dictionary with acoustic features extracted from a real voice of the specified speaker; and estimate a degree of reproducibility of the synthetic speech, wherein the condition determination unit is further configured to determine one of the first dictionary and the second dictionary to be used based on a result of estimation of the degree-of-reproducibility.

* * * * *